US005715788A

United States Patent [19]

Tarr et al.

[11] Patent Number: 5,715,788

[45] Date of Patent: Feb. 10, 1998

[54] INTEGRATED FUEL INJECTOR AND IGNITOR ASSEMBLY

[75] Inventors: Yul J. Tarr; Donald J. Benson; Gary L. Hunter, all of Columbus, Ind.

[73] Assignee: Cummins Engine Company, Inc., Columbus, Ind.

[21] Appl. No.: 688,244

[22] Filed: Jul. 29, 1996

[51] Int. Cl.[6] ..... F02M 57/06

[52] U.S. Cl. ..... 123/297; 123/635

[58] Field of Search ..... 123/297, 168 V, 123/169 EB, 296, 470, 635; 313/120, 143, 122

[56] References Cited

U.S. PATENT DOCUMENTS

| | | | |
|---|---|---|---|
| 3,204,139 | 8/1965 | Candelise | 313/120 |
| 3,247,833 | 4/1966 | Beddoes et al. | 123/32 |
| 3,908,625 | 9/1975 | Romy | 123/32 SP |
| 4,343,272 | 8/1982 | Buck | 123/297 |
| 4,448,160 | 5/1984 | Vosper | 123/297 |
| 4,736,718 | 4/1988 | Linder | 123/267 |
| 4,777,925 | 10/1988 | LaSota | 123/635 |
| 4,864,989 | 9/1989 | Markley | 123/267 |
| 5,012,787 | 5/1991 | Hafner et al. | 123/470 |
| 5,392,749 | 2/1995 | Stockner et al. | 123/470 |
| 5,497,744 | 3/1996 | Nagaosa et al. | 123/297 |
| 5,531,199 | 7/1996 | Bryant et al. | 123/297 |

FOREIGN PATENT DOCUMENTS

| | | |
|---|---|---|
| 632198 A1 | 4/1995 | European Pat. Off. . |
| 2503983 | 8/1975 | Germany . |

*Primary Examiner*—Willis R. Wolfe
*Assistant Examiner*—Hieu Ti Vo
*Attorney, Agent, or Firm*—Sixbey, Friedman, Leedom & Ferguson; Charles M. Leedom, Jr.; Tim L. Brackett, Jr.

[57] ABSTRACT

An integrated fuel injector and ignitor assembly is provided which includes an injector body, a fuel control valve and an ignition device. The components are packaged to create a compact assembly for positioning within an injector mounting bore and particularly in a mounting bore of an existing diesel engine. The assembly may include a fuel reservoir for accumulating fuel for injection so as to stabilize the injection pressure. Also, the ignition device may include an ignition coil mounted on the injector body and a replaceable ignitor electrode cartridge mounted on an opposite end of the injector body to permit simple, cost effective replacement of the electrodes/spark plug.

29 Claims, 2 Drawing Sheets

INTEGRATED FUEL INJECTOR AND IGNITOR ASSEMBLY

TECHNICAL FIELD

This invention relates to an improved fuel injector assembly including an ignitor for an internal combustion engine which effectively delivers precise quantities of fuel for injection and ignites the fuel/air mixture to enable optimum combustion.

BACKGROUND OF THE INVENTION

Recently, natural gas engines have become more attractive due to the low emissions and high fuel efficiency capability associated with the use of natural gas in comparison to diesel fuel and gasoline. As a result, engine manufacturers are developing engines specifically designed to use natural gas in an effective and efficient manner. However, these development efforts are very expensive and time consuming. As an alternative, other engine and/or fuel system manufacturers are developing ways of converting existing diesel engine designs to engines capable of burning natural gas by modifying the diesel engine. These modifications often require major changes to large engine components disadvantageously resulting in high costs.

For example, fuel is supplied to internal combustion engines using various fuel delivery devices such as fuel injectors and carburetors. In diesel engines, fuel injectors are normally mounted in the cylinder head for injecting diesel fuel directly into the respective cylinder. A common manner of converting a diesel engine to an engine capable of using natural gas includes modifying the intake manifold/cylinder head to include a fuel injector mounting cavity for receiving the injector. The injector is mounted in the intake manifold for injecting diesel fuel into the intake port for mixing with intake air prior to entering the cylinder. The existing fuel injector cavity formed above the combustion chamber is typically used to mount a spark plug. However, such modifications to the engine intake manifold/head are complex and expensive.

U.S. Pat. No. 4,448,160 to Vosper discloses a combination fuel injector and ignitor for use with gaseous fuels, such as hydrogen, which includes a spark plug assembly. The flow of hydrogen to the combined fuel injector and ignitor is controlled by a solenoid valve. However, this injector and ignitor assembly is designed for mounting in a spark plug bore of a spark-ignition engine and therefore would require modification for mounting in an existing fuel injector bore of a diesel engine. Also, the solenoid operated fuel flow control valve is positioned separate from the injector undesirably resulting in increased injection response time. In addition, the injector disclosed in Vosper supplies fuel from the fuel source via relatively low volume passages which is likely to result in less than optimum flow and pressure levels throughout an injection event.

U.S. Pat. No. 4,343,272 to Buck and 4,864,989 to Markley both disclose spark plug devices including fuel passages for delivering fuel for ignition by the spark plug. German Patent No. 2503983 appears to disclose a similar spark plug device. However, the fuel supplied to the plug is used solely to initiate combustion while a primary supply of fuel is supplied to the combustion chamber via the intake port. As a result, these spark plugs are likely to be incapable of injecting a sufficient quantity of fuel necessary to generate an acceptable combustion event. Also, these spark plugs do not include a fuel flow control valve nor an ignition coil. In addition, these devices are not designed for mounting in an injector mounting bore of a diesel engine.

Consequently, there is a need for a low cost natural gas fuel injector which includes an ignitor or spark plug and fuel flow control valve in an integrated assembly capable of effectively controlling fuel injection and ignition.

SUMMARY OF THE INVENTION

It is an object of the present invention, therefore, to overcome the disadvantages of the prior art and to provide an integrated fuel injector and ignitor assembly for an internal combustion engine which is capable of effectively and reliably controlling fuel injection and ignition.

It is another object of the present invention to provide an integrated fuel injector and ignitor assembly for an internal combustion engine capable of being easily mounted in the fuel injector mounting bore of an existing engine without significant costs and modifications to the engine.

It is yet another object of the present invention to provide an integrated fuel injector and ignitor assembly for an internal combustion engine capable of producing a stratified charge having a rich mixture at the ignitor and a lean mixture in the engine cylinder.

A further object of the present invention is to provide an integrated fuel injector and ignitor assembly for an internal combustion engine capable of effectively and reliably supplying the entire amount of fuel for combustion directly into the engine cylinder while minimizing fuel pressure fluctuations during an injection event.

Still another object of the present invention is to provide an integrated fuel injector and ignitor assembly for an internal combustion engine which also includes an integrated fuel control valve.

Yet another object of the present invention is to provide an integrated fuel injector and ignitor assembly for an internal combustion engine which also includes an integrated ignition coil.

A still further object of the present invention is to provide an integrated fuel injector, ignitor and fuel control valve assembly for an internal combustion engine which prevents cylinder gas flow back through the assembly upon an inadvertent failure of the control valve into the open position.

Another object of the present invention is to provide an integrated fuel injector and ignitor assembly for an internal combustion engine which permits easy replacement of the ignitor assembly.

These and other objects are achieved by providing an integrated fuel injector and ignitor assembly for injecting a gaseous fuel into a cylinder of an internal combustion engine comprising an injector body containing an injector cavity, a fuel outlet communicating with one end of the injector cavity and a fuel metering circuit. An ignitor electrode device is positioned adjacent a first end of the injector body for generating a spark for igniting the gaseous fuel and a fuel control valve is positioned in the injector cavity for controlling fuel flow through the fuel metering circuit to define a fuel injection event. A gas reservoir formed in the injector cavity may be provided along the fuel metering circuit upstream of the fuel control valve for accumulating fuel for injection. An ignition coil may be mounted on the injector body, preferably, adjacent a second end of the body opposite the first end. The fuel control valve includes a control valve element mounted for reciprocal movement between an open position permitting fuel flow from the metering circuit through the fuel outlet and a closed position blocking fuel flow from the metering circuit. The control valve element may extend along a longitudinal axis of the injector body. The ignitor electrode device may include a first electrode extending along the longitudinal axis of the injector body and a second electrode. The fuel control valve may further include a solenoid device including a coil, a stator, and an armature connected to the control valve element. The control valve may further include a control valve seat positioned in the cavity between the solenoid device and the first end of the body. The assembly may also include a spring biased check valve positioned in the injector cavity between the injection control valve and the fuel outlet for blocking flow from the fuel outlet into the injector cavity. Also, the first electrode may be encased in an insulating sleeve having a delivery passage formed therein for permitting fuel flow from the fuel control valve to the fuel outlet. The control valve element may be designed to move toward the first end of the injector body into an open position or closed position depending on the arrangement. Also, the assembly may further include a pre-combustion chamber positioned between the fuel control valve and the fuel outlet. The injector body may be positionable in an injector mounting bore formed in a cylinder head of an engine in such a manner to permit the fuel metering circuit to fluidically communicate with a fuel supply passage formed in the cylinder head.

The integrated fuel injector and ignitor assembly of the present invention may be in the form of an injector body including a fuel metering circuit and a replaceable ignitor electrode cartridge removably mounted on the first end of the injector body. The ignitor electrode cartridge includes a plurality of ignitor electrodes for generating a spark for igniting the gaseous fuel. The cartridge may also include an insulating sleeve surrounding at least a portion of one of the plurality of ignitor electrodes. The replaceable ignitor electrode cartridge may also include the pre-combustionchamber integrally formed therein.

DETAILED DESCRIPTION OF THE INVENTION

Figure 1:
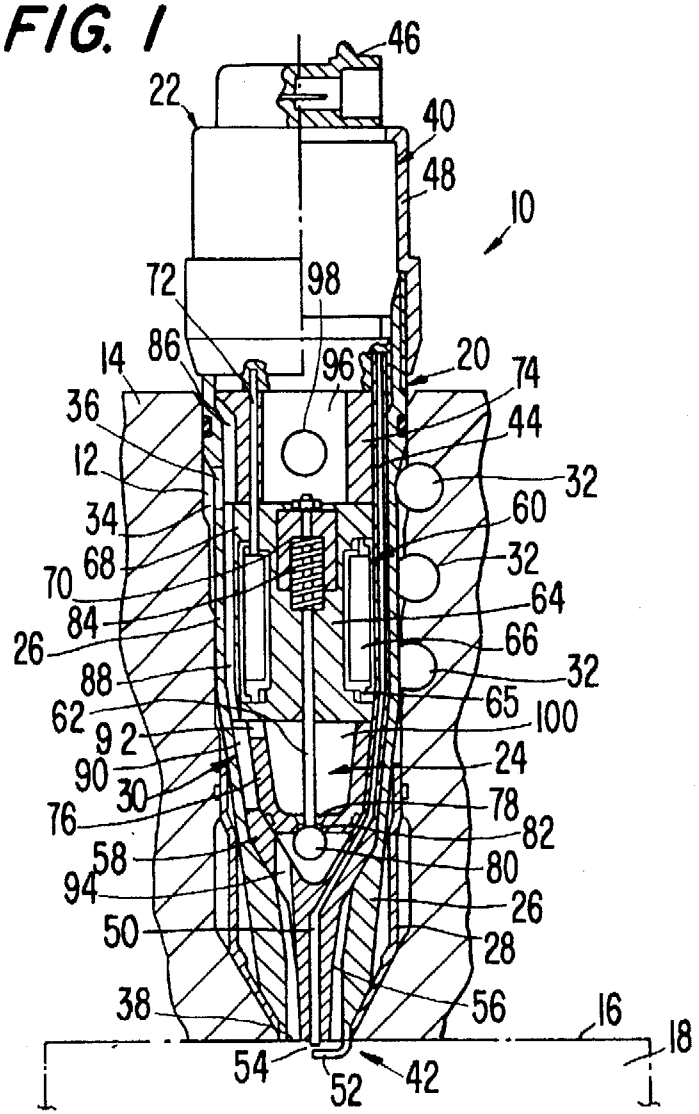
FIG. 1 is a cross sectional view of the integrated fuel injector and ignitor assembly of the present invention positioned in an injector mounting bore formed in the cylinder head of an engine.

Referring to FIG. 1, there is shown an integrated fuel injector and ignitor assembly 10 of the present invention positioned in an injector mounting bore 12 formed in a cylinder head 14 of an engine. The injector mounting bore 12 is preferably located immediately above a respective engine cylinder 16 forming a combustion chamber 18. For example, injector mounting bore 12 may be formed in a diesel engine for receiving a conventional diesel fuel injector for injecting liquid diesel fuel. In this manner, the present integrated fuel injector and ignitor assembly permits conversion of existing diesel engines into engines capable of operating on gaseous fuels such as natural gas, at minimal cost.

Generally, the gaseous fuel injector and ignitor assembly 10 includes an injector body 20 forming an injector cavity, an ignitor means 22 mounted on injector body 20 and a fuel control valve 24 mounted in the injector cavity. Injector body 20 includes a generally cylindrical retainer 26 for housing various components of the assembly 10. The inner end of retainer 26 is positioned in a guide sleeve 28 located in the inner portion of bore 12. Injector body 20 further includes a fuel metering circuit, indicated generally at 30, extending therethrough for delivering gaseous fuel from one or more fuel supply passages or rails 32 formed in cylinder head 14. Retainer 26 is sized to create an annular clearance passage 34 adjacent fuel supply passages 32 for delivering the gaseous fuel to fuel metering circuit 30. Fuel metering circuit 30 includes a fuel inlet 36 formed in retainer 26 adjacent clearance passage 34 and a fuel outlet 38 formed in the inner end of retainer 26 for discharging gaseous fuel into combustion chamber 18.

Ignitor means 22 includes an ignition coil 40 mounted on the outer end of retainer 26, an ignitor electrode device 42 positioned at the inner end of retainer 26 and an electrical connection 44 extending through the injector cavity to electrically connect coil 40 and electrode device 42. Ignition coil 40 may be any conventional ignition coil capable of producing a sufficiently high voltage at ignitor electrode device 42 while preferably minimizing the size of the injector and ignitor assembly 10. Ignition coil 40 includes a plug connector 46 for connecting an external power source to coil 40. Plug connector 46 is formed on the top of a coil retainer or housing 48 which encases ignition coil 40 and threadably engages the outer end of retainer 26. Ignitor electrode device 42 includes a first spark plug electrode 50 positioned at the inner end of, and extending along the longitudinal axis of, injector body 20. A second spark plug electrode 52 is integrally formed on the inner end of retainer 26 and positioned immediately adjacent first electrode 50 to form a spark gap 54. Electrical connection 44 includes a connector 54 connected to the outer end of first electrode 50 and extending along the inner wall of retainer 26 outwardly to connect with ignition coil 40. Connector 54 may be integrally formed with first electrode 50. First electrode 50 and connector 54 are insulated from the surrounding assembly parts by an insulating sleeve 56 formed of an insulative material, i.e. ceramic, which encases first electrode 50 and connector 54 along their entire length except the portion forming spark gap 54. Insulating sleeve 56 includes a conical portion 58 for abutment against a complementary tapered portion formed on the inner surface of retainer 26.

Fuel control valve 24 includes a solenoid actuator 60 and a control valve element 62 movable by solenoid actuator 60 into open and closed positions. Solenoid actuator 60 includes a pole piece 64, a coil 66 wound on a bobbin 65 which is mounted on pole piece 64, a coil housing 68 surrounding coil 66 and an armature 70. Control valve element 62 is rigidly connected to armature 70 which, in turn, is mounted for slidable reciprocal movement in the outer end of coil housing 68. A solenoid connector 72 connects at one end to coil 66 and extends through the injector cavity to connect with an external electrical supply via, for example, plug connector 46.

Injector body 20 further includes a spacer 74 positioned between ignition coil 40 and housing 68. In addition, injector body 20 includes an inner spacer 76 positioned between pole piece 64 and conical portion 58 of insulating sleeve 56. The components positioned in injector body 20 are held in compressive abutting relationship by the simple relative rotation of housing 48 on the end of retainer 26. Inner spacer 76 includes a valve passage 78 for receiving one end of control valve element 62. A valve head 80 formed on the end of control valve element 62 is positioned to sealingly engage an annular valve seat 82 formed on the inner end of inner spacer 76. A coil spring 84, positioned in a cavity formed in armature 70, abuts pole piece 64 at one end and armature 70 at an opposite end so as to bias armature 70 and control valve element 62 outwardly. Thus, when solenoid actuator 60 is de-energized, coil spring 84 biases valve head 80 into sealing engagement against annular valve seat 82.

Fuel metering circuit 30 includes a semiannular recess 86 formed on the outer surface of outer spacer 74 adjacent fuel inlet 36 and a plurality of axial passages 88 equally spaced around the circumference of coil housing 68. Axial passages 88 connect semiannular recess 86 with a passage 90 formed between retainer 26 and inner spacer 76. A transverse passage 92 extends through the wall of inner spacer 76 to direct gaseous fuel to valve passage 78. A delivery passage 94 extends through insulating sleeve 56 to direct fuel exiting valve passage 78 toward fuel outlet 38.

Fuel injector and ignitor assembly 10 also includes a first reservoir 96 formed in outer spacer 74 for accumulating a supply of gaseous fuel for delivery to fuel outlet 38 via fuel control valve 24 during an injection event. An exchange port 98 formed in outer spacer 74 communicates first reservoir 96 with semiannular recess 86. Also, a second reservoir 100 is formed in inner spacer 76 immediately upstream of valve passage 78 for receiving and accumulating gaseous fuel delivered via transverse passage 92. First and second reservoirs 96, 100 function to provide an accumulated pressurized supply of gaseous fuel which advantageously stabilizes the injection pressure during an injection event and substantially avoids pressure losses typically associated with accumulators positioned upstream of a conventional injector assembly.

During operation, with fuel control valve 24 de-energized and control valve element 62 in the closed position as shown in FIG. 1, pressurized gaseous fuel from fuel supply passage 32 fills first reservoir 96 and second reservoir 100. At a predetermined time during engine operation as determined by an electronic control unit (ECU—not shown), solenoid actuator 60 is actuated causing armature 70 to move inwardly against the bias force of spring 84. As a result, control valve element 62 moves inwardly causing valve head 80 to move away from valve seat 82 into an open position thus beginning an injection event. During the injection event, gaseous fuel from fuel supply passage 32, first reservoir 96 and second reservoir 100, flows through valve passage 78, delivery passage 94 and into combustion chamber 18 via fuel outlet 38. After a predetermined period of time, the ECU signals for the deactuation of solenoid actuator 60 permitting the bias force of coil spring 84 to move armature 70 and control valve element 62 upwardly forcing valve head 80 into sealing engagement with valve seat 82, thus terminating fuel flow through fuel outlet 38 to mark the end of the injection event. At a predetermined time, the ECU initiates the energization of ignition coil 40 resulting in a spark in the spark gap 54 between first and second electrodes 50, 52 in a known manner.

Figure 2:
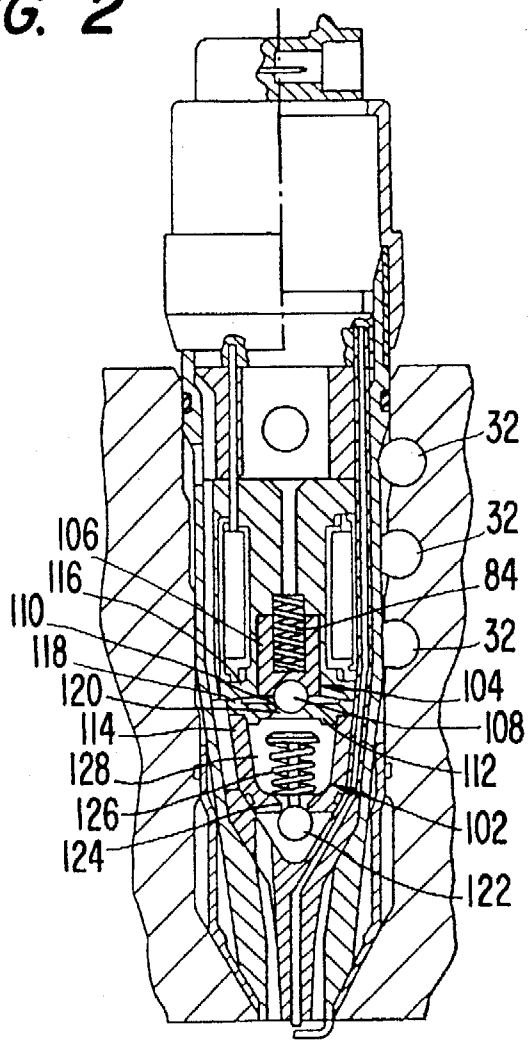
FIG. 2 is a cross sectional view of a second embodiment of the integrated fuel injector and ignitor assembly of the present invention including an injection check valve.

FIG. 2 represents a second embodiment of the injector and ignitor assembly of the present invention which is similar to the embodiment of FIG. 1 except for the presence of a spring-biased check valve 102 positioned downstream of a modified fuel control valve 104. Fuel control valve 104 is basically the same structure as the fuel control valve 24 but rotated 180 degrees, or turned upside down, so that an armature 106 is positioned on the inward side of control valve 104. Thus, coil spring 84 biases armature 106 inwardly toward fuel outlet 38. In this embodiment, a valve head 108 is mounted directly on armature 106 for abutment against a valve seat 110. Valve seat 110 is formed on a valve seat member 112 positioned between an inner spacer 114 and the inner end of a coil housing 116. A transverse delivery passage 118 delivers gaseous fuel from passage 90 to a valve passage 120 formed in member 112. Check valve 102 includes a valve element 122 biased against a valve seat 124 formed around a passage extending through inner spacer 114. A coil spring 126 positioned in a cavity 128 formed in inner spacer 76 biases valve element 122 into a closed position against valve seat 124. This arrangement provides fail safe operation in the event fuel control valve 104 fails to operate properly caused by, for example, the failure of coil spring 84. In this case, armature 106 and valve head 108 would likely fail into a closed position against valve seat 110 while check valve 102 would effectively prevent highly pressurized combustion gases from entering the injector and ignitor assembly and the upstream gaseous fuel supply system.

Figure 3:
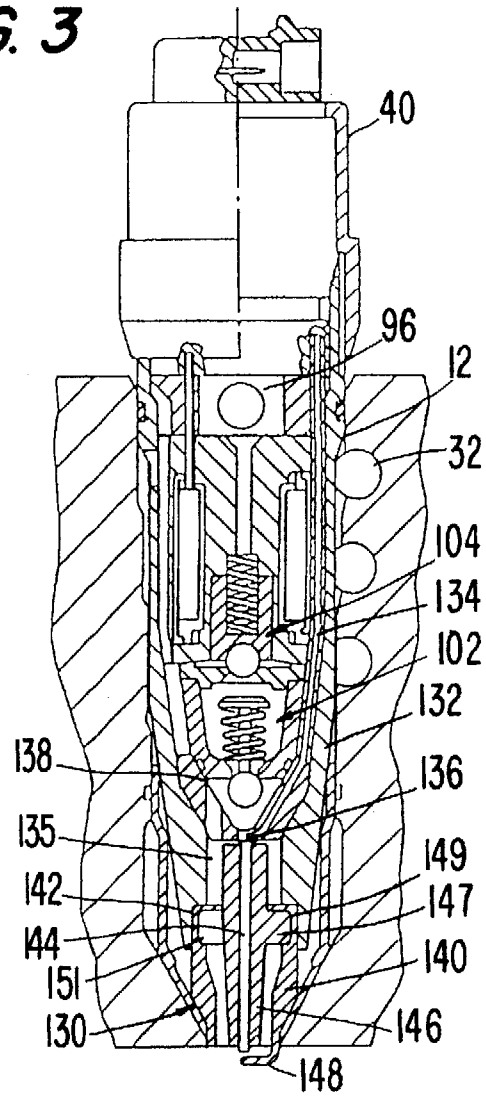
FIG. 3 is a cross sectional view of a third embodiment of the integrated fuel injector and ignitor assembly of the present invention including a replaceable ignitor electrode cartridge.

FIG. 3 illustrates a third embodiment of the assembly of the present invention which is very similar to the embodiment shown in FIG. 2 except for the use of a replaceable ignitor electrode cartridge 130. Components of the present embodiment which are the same as the previous embodiment are indicated by like reference numerals. In this embodiment, an injector and ignitor retainer 132 terminates prior to the inner end of injector mounting bore 12. Also, an electrical connection 134 extending between ignition coil 40 and ignitor electrode cartridge 130 terminates at the inner end of a cavity 135 formed in the inner end of retainer 132. Electrical connection 134 includes an inner contact 136 facing cavity 135 but otherwise surrounded by an insulator 138. Replaceable ignitor electrode cartridge 130 includes a housing 140 for positioning in a recess 142 formed on the end of retainer 132. Electrode cartridge 130 also includes a first electrode 144 extending axially through housing 140 and surrounded by an insulating sleeve 146 formed of, for example, a ceramic material. Insulating sleeve 146 includes an annular ring 147 for engaging an annular recess 149 formed in housing 140 to secure first electrode 144 in housing 140. Sleeve 146 also includes a delivery passage 151 formed in annular ring 147 for delivering gaseous fuel through cavity 135 to the injector outlet. First electrode 144 and insulating sleeve 146 extend from the outer end of housing 140 a predetermined distance such that when housing 140 is positioned in recess 142, first ignitor 144 abuts inner contact 136 to provide a secure electrical connection between electrical connection 134 and first electrode 144. Ignitor electrode cartridge 130 also includes a second electrode 148 integrally formed on the inner end of housing 140. As with many conventional spark plugs, first and second electrodes 144, 148 will likely gradually deteriorate during use due to extreme operating conditions. This embodiment permits the electrodes to be simply and easily replaced in a cost effective manner with an unused ignitor electrode cartridge and without replacing other components of the assembly.

Figure 4:
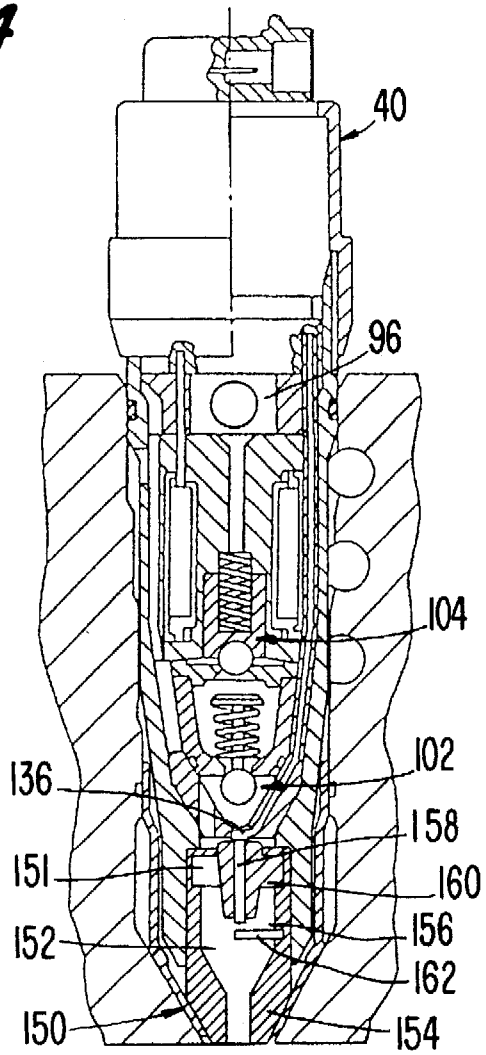
FIG. 4 is a cross sectional view of a fourth embodiment of the integrated fuel injector and ignitor assembly of the present invention including a replaceable ignitor electrode cartridge having a pre-combustion chamber.

FIG. 4 represents yet another embodiment of the present injector and ignitor assembly which is very similar to the embodiment of FIG. 3 except that a replaceable ignitor electrode cartridge 150 includes a pre-combustion chamber 152. Components of the present embodiment which are the same as the previous embodiment are indicated by like reference numerals. Cartridge 150 includes a generally cylindrical shaped housing 154 having an internal cavity 156 which forms pre-combustion chamber 152. Like the embodiment of FIG. 3, a first electrode 158 is positioned in an insulating sleeve 160 for abutment against inner contact 136. A second electrode 162 extends from housing 154 into pre-combustion chamber 152 adjacent first electrode 158. The basic function of the pre-combustion chamber is to provide a chamber where the gaseous fuel can be combined with a portion of the air in the combustion chamber to form a rich mixture consistently ignitible by the integral ignitor/spark plug. The mixture when ignited provides the required energy to cause combustion of the very lean mixture within the main combustion chamber 18 at the optimum time for efficiency and/or pollution control. Thus, pre-combustion chamber 152 assists in creating a stratified charge wherein the mixture in the pre-combustion chamber is rich compared to the lean mixture in the main combustion chamber 18. Thus, compared to assemblies which position the ignitor in the main combustion chamber, this embodiment more effectively ensures optimum ignition of the gas mixture in the main combustion chamber during all operating conditions.

The present invention achieves many advantages over conventional gaseous fuel systems. For example, by utilizing the existing injector mounting bore 12 formed in the cylinder head of existing diesel engines, the present invention creates a cost effective manner of transforming diesel engines into gaseous fuel engines. Secondly, the present fuel injector and ignitor assembly minimizes the electrical energy losses and ensures high voltage delivery to the ignitor electrodes by positioning an ignition coil 40 on each injector thereby minimizing the distance between the electrodes and the electrical source. This arrangement also reduces the likelihood of inadequate spark generation thus minimizing misfires and decreasing emissions. Third, the present assembly integrates an accumulated volume of gaseous fuel into the injector so as to minimize pressure losses and ensure a stabilized pressure level throughout each injection event. Fourth, the present invention creates an injector and ignitor assembly having an ignitor electrode device which can be easily replaced with another ignitor electrode cartridge 130 thus providing a simple, cost effective manner of replacing deteriorated electrodes. Fifth, the arrangement of the components of the present assembly creates a uniquely compact yet effective injector and ignitor assembly sized to fit within the packaging constraints of many engines.

INDUSTRIAL APPLICABILITY

The gaseous fuel injector and ignitor assembly of the present invention may be used in any spark ignition engine capable of operating on gaseous fuel, such as natural gas, including engines serving vehicles and industrial equipment. The present assembly is particularly advantageous when used to convert a diesel engine into a spark ignition, gaseous fuel engine.

We claim:

1. An integrated fuel injector and ignitor assembly for injecting a gaseous fuel into a cylinder of an internal combustion engine comprising:

an injector body containing an injector cavity, a fuel outlet communicating with one end of said injector cavity and a fuel metering circuit;

an ignitor electrode device positioned adjacent a first end of said injector body for generating a spark for igniting the gaseous fuel, said ignitor electrode device including a first electrode and a second electrode; and a fuel control valve positioned in said injector cavity for controlling fuel flow through said fuel metering circuit so as to define a fuel injection event wherein said fuel control valve includes a control valve element mounted for reciprocal movement between an open position permitting fuel flow from said metering circuit through said fuel outlet and a closed position blocking fuel flow from said metering circuit, a solenoid means for moving said control valve element, and a control valve seat positioned in said injector cavity between said solenoid means and said first end of said injector body wherein said control valve seat and said control valve element are non-integral with and separable from said first and said second ignitor electrodes.

2. The integrated fuel injector and ignitor assembly of claim 1, further including a reservoir formed in said injector cavity along said fuel metering circuit upstream of said fuel control valve for accumulating fuel for injection.

3. The integrated fuel injector and ignitor assembly of claim 2, further including an ignition coil mounted on said injector body.

4. The integrated fuel injector and ignitor assembly of claim 1, further including an ignition coil mounted on said injector body.

5. The integrated fuel injector and ignitor assembly of claim 3, wherein said coil is mounted on a second end of said injector body opposite said first end.

6. The integrated fuel injector and ignitor assembly of claim 1, wherein said control valve element and said first electrode extend along a longitudinal axis of said injector body.

7. The integrated fuel injector and ignitor assembly of claim 1, wherein said solenoid means includes a coil, a pole piece, and an armature connected to said control valve element.

8. The integrated fuel injector and ignitor assembly of claim 1, further including a spring biased check valve positioned in said injector cavity between said injection control valve and said fuel outlet for blocking flow from said fuel outlet into said injector cavity.

9. The integrated fuel injector and ignitor assembly of claim 1, wherein said ignitor electrode device includes a first electrode and a second electrode, further including an insulating sleeve encasing at least a portion of said first ignitor electrode and a delivery passage formed in said insulating sleeve for permitting fuel flow from said fuel control valve to said fuel outlet.

10. The integrated fuel injector and ignitor assembly of claim 1, further including a pre-combustion chamber positioned between said fuel control valve and said fuel outlet.

11. The integrated fuel injector and ignitor assembly of claim 6, wherein said control valve element moves toward said first end of said injector body into said open position.

12. The integrated fuel injector and ignitor assembly of claim 6, wherein said control valve element moves toward said first end of said injector body into said closed position.

13. The integrated fuel injector and ignitor assembly of claim 1, wherein said injector body is positionable in an injector mounting bore formed in a cylinder head of the engine, further including a fuel supply passage formed in said cylinder head and opening into said injector mounting bore, said fuel metering circuit being in fluidic communication with said fuel supply passage when said injector body is positioned in said injector mounting bore.

14. The integrated fuel injector and ignitor assembly of claim 10, wherein said ignitor electrode device includes a replaceable ignitor electrode cartridge removably mounted on a first end of said injector body.

15. An integrated fuel injector and ignitor assembly capable of mounting in an injector mounting bore formed in a cylinder head of an internal combustion engine for injecting a gaseous fuel into a cylinder of the engine, comprising:

an injector body containing an injector cavity, a fuel inlet, a fuel outlet communicating with one end of said injector cavity and a fuel metering circuit for delivering fuel to said fuel outlet;

an ignition means for igniting the gaseous fuel, said ignition means including an ignitor electrode positioned adjacent a first end of said injector body and an ignition coil mounted on said injector body and electrically connected to said ignitor electrode; and a fuel supply means including a fuel supply passage formed in the cylinder head of the engine and communicating with said injector mounting bore, wherein said fuel inlet is positioned to receive fuel from said fuel supply passage when said injector body is positioned in said injector mounting bore.

16. The integrated fuel injector and ignitor assembly of claim 15, wherein said ignition coil is mounted on a second end of said injector body opposite said first end.

17. The integrated fuel injector and ignitor assembly of claim 16, further including a fuel control valve positioned in said injector body for controlling fuel flow through said fuel metering circuit so as to define a fuel injection event.

18. The integrated fuel injector and ignitor assembly of claim 17, further including a spring biased check valve positioned in said injector cavity between said injection control valve and said fuel outlet for blocking flow from said fuel outlet into said injector cavity.

19. The integrated fuel injector and ignitor assembly of claim 15, further including a reservoir formed in said injector cavity along said fuel metering circuit upstream of said fuel control valve for accumulating fuel for injection.

20. The integrated fuel injector and ignitor assembly of claim 15, wherein said ignition means further includes a replaceable ignitor electrode cartridge removably mounted on said first end of said injector body, said ignitor electrode integrally formed in said replaceable ignitor electrode cartridge.

21. The integrated fuel injector and ignitor assembly of claim 20, wherein said replaceable ignitor electrode cartridge includes a pre-combustion chamber.

22. An integrated fuel injector and ignitor assembly for injecting a gaseous fuel into a cylinder of an internal combustion engine, comprising:

an injector body containing an injector cavity, a fuel outlet communicating with one end of said injector cavity and a fuel metering circuit extending through said injector cavity;

a replaceable ignitor electrode cartridge removably mounted on a first end of said injector body, said ignitor electrode cartridge including a cartridge housing and a plurality of ignitor electrodes attached to said cartridge housing for generating a spark for igniting the gaseous fuel.

23. The integrated fuel injector and ignitor assembly of claim 22, further including an ignition coil mounted on said injector body.

24. The integrated fuel injector and ignitor assembly of claim 23, wherein said coil is mounted on a second end of said injector body opposite said first end.

25. The integrated fuel injector and ignitor assembly of claim 22, wherein said replaceable ignitor electrode cartridge includes an insulating sleeve surrounding at least a portion of one of said plurality of ignitor electrodes, said insulating sleeve including a delivery passage for permitting fuel flow.

26. The integrated fuel injector and ignitor assembly of claim 22, further including a fuel control valve positioned in said injector body for controlling fuel flow through said fuel metering circuit so as to define a fuel injection event.

27. The integrated fuel injector and ignitor assembly of claim 26, further including a reservoir formed in said injector cavity along said fuel metering circuit upstream of said fuel control valve for accumulating fuel for injection.

28. The integrated fuel injector and ignitor assembly of claim 22, wherein said replaceable ignitor electrode cartridge includes a pre-combustion chamber.

29. An integrated fuel injector and ignitor assembly for injecting a gaseous fuel into a cylinder of an internal combustion engine comprising:

an injector body containing an injector cavity, a fuel outlet communicating with one end of said injector cavity and a fuel metering circuit;

an ignition means for igniting the gaseous fuel, said ignition means including an ignitor electrode positioned adjacent a first end of said injector body for generating a spark for igniting the gaseous fuel and an ignition coil mounted on a second end of said injector body opposite said first end and electrically connected to said ignitor electrode; and a fuel control valve positioned in said injector cavity for controlling fuel flow through said fuel metering circuit so as to define a fuel injection event wherein said fuel control valve includes a control valve element mounted for reciprocal movement between an open position permitting fuel flow from said metering circuit through said fuel outlet and a closed position blocking fuel flow from said metering circuit, and a solenoid means for moving said control valve element, wherein said solenoid means is positioned axially along said injector body between said ignition coil and said first end of said injector body.

* * * * *